US009853368B2

(12) United States Patent
Myer et al.

(10) Patent No.: US 9,853,368 B2
(45) Date of Patent: Dec. 26, 2017

(54) ELECTRICAL CRIMP TERMINAL

(71) Applicant: TYCO ELECTRONICS CORPORATION, Berwyn, PA (US)

(72) Inventors: John Mark Myer, Millersville, PA (US); Rodney Timothy Yancey, East Petersburg, PA (US); John G. Bushey, Dillsburg, PA (US); Ricky S. Leight, York, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/144,984

(22) Filed: May 3, 2016

(65) Prior Publication Data

US 2017/0324172 A1 Nov. 9, 2017

(51) Int. Cl.
*H01R 4/10* (2006.01)
*H01R 4/18* (2006.01)

(52) U.S. Cl.
CPC ..... *H01R 4/188* (2013.01); *H01R 4/185* (2013.01)

(58) Field of Classification Search
CPC ..... H01R 4/185; H01R 4/188; H01R 4/20; H01R 43/16; H01R 43/058
USPC ..... 439/877
See application file for complete search history.

(56) References Cited

U.S. PATENT DOCUMENTS 6,749,457 B2 6/2004 Sakaguchi et al.
8,070,536 B2 * 12/2011 Ono ..... H01R 4/185 439/877
8,177,591 B2 5/2012 Okamura et al.
8,210,884 B2 * 7/2012 Corman ..... H01R 4/185 439/877
8,622,774 B2 1/2014 Seifert et al.
8,870,611 B2 * 10/2014 Sato ..... H01R 4/185 439/442
8,876,563 B2 * 11/2014 Onuma ..... H01R 4/188 439/877
8,944,862 B2 * 2/2015 Sato ..... H01R 4/188 439/877
8,979,601 B2 3/2015 Schmidt et al.
(Continued)

FOREIGN PATENT DOCUMENTS

NL 7217671 A 7/1974

OTHER PUBLICATIONS

International Search Report, International Application PCT/IB2017/052320, International Filing Date Apr. 21, 2017.

*Primary Examiner* — Abdullah Riyami
*Assistant Examiner* — Vladimir Imas

(57) ABSTRACT

An electrical terminal includes a crimp barrel having an interior side and an exterior side. The interior side of the crimp barrel defines a channel that extends along a longitudinal axis. The crimp barrel is configured to mechanically hold and electrically connect to one or more electrical conductors of an electrical device received in the channel. The crimp barrel includes multiple primary serrations spaced apart along the longitudinal axis. The primary serrations are groove-shaped recesses formed along the interior side. Adjacent primary serrations are separated from one another by a band. The crimp barrel further includes at least one micro-serration on the band. Each micro-serration is a groove-shaped recess formed along the interior side that has a smaller size relative to the primary serrations.

20 Claims, 6 Drawing Sheets

(56) References Cited

U.S. PATENT DOCUMENTS

| | | | | |
|---|---|---|---|---|
| 9,039,467 | B2 * | 5/2015 | Seipel | H01R 4/185<br>439/877 |
| 9,048,550 | B2 | 6/2015 | Onuma et al. | |
| 9,172,151 | B2 * | 10/2015 | Sato | H01R 4/206 |
| 9,246,292 | B2 * | 1/2016 | Tachibana | H01R 43/048 |

* cited by examiner

ELECTRICAL CRIMP TERMINAL

BACKGROUND OF THE INVENTION

The subject matter described and/or illustrated herein relates generally to electrical crimp terminals configured to be crimped to electrical devices, such as cables or wires.

Electrical crimp terminals are often used to terminate the ends of wires or other electrical devices. Some electrical terminals include a crimp barrel and an electrical contact. The crimp barrel is crimped around the end of the wire to establish an electrical connection between electrical conductors in the wire and the terminal as well as to mechanically hold the electrical terminal on the wire. When crimped over the wire, the crimp barrel establishes an electrical and mechanical connection between the conductors of the wire and the electrical contact of the terminal, such that the terminal carries current from the wire to the mating component connected to the electrical contact.

Conductors of wires are often fabricated from metal materials, such as copper and aluminum, which may form poorly conductive oxide layers on the exterior surface of the wire conductors when exposed to air. Furthermore, build-up of surface contaminants from processing steps may further inhibit surface conductivity. Such exterior conductor surface oxide layers must be penetrated in order to form reliable metal-to-metal connections between the metal material of the wire and the metal material of the electrical crimp terminal. For example, some crimp barrels include one or more serrations that, during a crimping operation, are configured to scrape or wipe against the conductors of the wire to displace the oxide layer and expose fresh metal of the conductors for establishing a metal-to-metal connection.

But, it may be difficult to displace enough of the oxide layer during the crimping operation to achieve a sufficient electrical and mechanical bond, and thereby establish a reliable electrical connection, especially for electrical terminals formed of metal materials that are similar in strength to the materials of the wire conductors. For example, some electrical terminals are formed of lower-strength metals than traditional terminals in order to reduce cost and improve electrical conductivity of the terminals relative to higher-strength metals. But, during a crimping operation, when the terminal has a similar strength or elasticity as the wire conductors, both the terminal and the wire conductors may extrude or flow with similar characteristics such that there may be little differential or relative flow between the terminal and the wire conductors. The reduced differential flow inhibits the ability for the existing serrations to wipe and scrape against the conductors to displace the oxide layer, resulting in a poor electrical connection between the terminal and the wire.

A need remains for an electrical crimp terminal that is able to displace the oxide layer on electrical conductors in the crimp barrel during a crimping operation to provide a reliable electrical connection between the terminal and the electrical conductors, even when there is limited differential flow between the metal of the terminal and the metal of the conductors during the crimping operation.

BRIEF DESCRIPTION OF THE INVENTION

In one embodiment, an electrical terminal is provided that includes a crimp barrel having an interior side and an exterior side. The interior side of the crimp barrel defines a channel that extends along a longitudinal axis. The crimp barrel is configured to mechanically hold and electrically connect to one or more electrical conductors of an electrical device received in the channel. The crimp barrel includes multiple primary serrations spaced apart along the longitudinal axis. The primary serrations are groove-shaped recesses formed along the interior side. Adjacent primary serrations are separated from one another by a band. The crimp barrel further includes at least one micro-serration on the band. Each micro-serration is a groove-shaped recess formed along the interior side that has a smaller size relative to the primary serrations.

In another embodiment, an electrical terminal is provided that includes a crimp barrel extending along a longitudinal axis between a contact end and a device end. The crimp barrel has an interior side that defines a channel extending along the longitudinal axis. The crimp barrel is configured to mechanically hold and electrically connect to one or more electrical conductors of an electrical device received in the channel. The crimp barrel includes multiple primary serrations and multiple micro-serrations in a serration array. The primary serrations and the micro-serrations are groove-shaped recesses formed along the interior side. The micro-serrations have a smaller size relative to the primary serrations. The micro-serrations are arranged in groups of at least one micro-serration. The groups of the micro-serrations and the primary serrations are arranged in an alternating sequence along the longitudinal axis such that one of the primary serrations is disposed between adjacent groups of micro-serrations and one of the groups of micro-serrations is disposed between adjacent primary serrations.

In another embodiment, an electrical terminal is provided that includes a crimp barrel having an interior side and an outer side. The interior side of the crimp barrel defines a channel that extends along a longitudinal axis. The crimp barrel is configured to mechanically hold and electrically connect to one or more electrical conductors of an electrical device received in the channel. The crimp barrel includes multiple primary serrations spaced apart along the longitudinal axis. Adjacent primary serrations are separated from one another by a band. The crimp barrel further includes at least one micro-serration on the band. The primary serrations and the at least one micro-serration are groove-shaped recesses formed along the interior side. The micro-serrations have a smaller size relative to the primary serrations. The primary serrations and the at least one micro-serration define barrel teeth. Each barrel tooth has a top surface that faces the channel and two tapered sides extending from two corresponding edges of the top surface. The edges of the barrel teeth are configured to engage and scrape against the one or more electrical conductors during a crimping operation to form metal-to-metal contacts.

DETAILED DESCRIPTION OF THE INVENTION

One or more embodiments described herein disclose an electrical terminal configured to be crimped to an electrical device, such as a wire or a cable, to form a terminal assembly (or contact lead). The electrical terminal may provide an improved electrical connection with the electrical device to which the terminal is crimped relative to known terminals. For example, the electrical terminal includes a serration array that includes serrations of multiple different sizes along an interior side of the terminal that engages the conductors of the electrical device. The serration array may provide enhanced scraping to remove or displace the poorly-conductive oxide layer on the conductors relative to the serrations on known terminals. For example, the serration array of the terminal disclosed herein may take advantage a limited differential flow or extrusion of the conductors relative to the terminal during the crimping process, which occurs when metal material of the conductors flows towards and at least partially fills the recesses formed by larger serrations of the serration array. As the metal material of the conductors flows towards the larger serrations, edges of the smaller serrations (which are proximate to the larger serrations) scrape against the metal material to remove and/or displace the oxide layer, creating a reliable metal-to-metal electrical connection. Since the serration array takes advantage of a limited differential flow between the conductors and the terminal, the terminal may be formed of a metal material that has a similar strength or elasticity as the metal material of the conductors. The metal material of the terminal may be preferable over metal materials used for known terminals because, for example, the metal material of the terminal disclosed herein may have a higher conductivity and a lower cost than the materials of known terminals.

Figure 1:
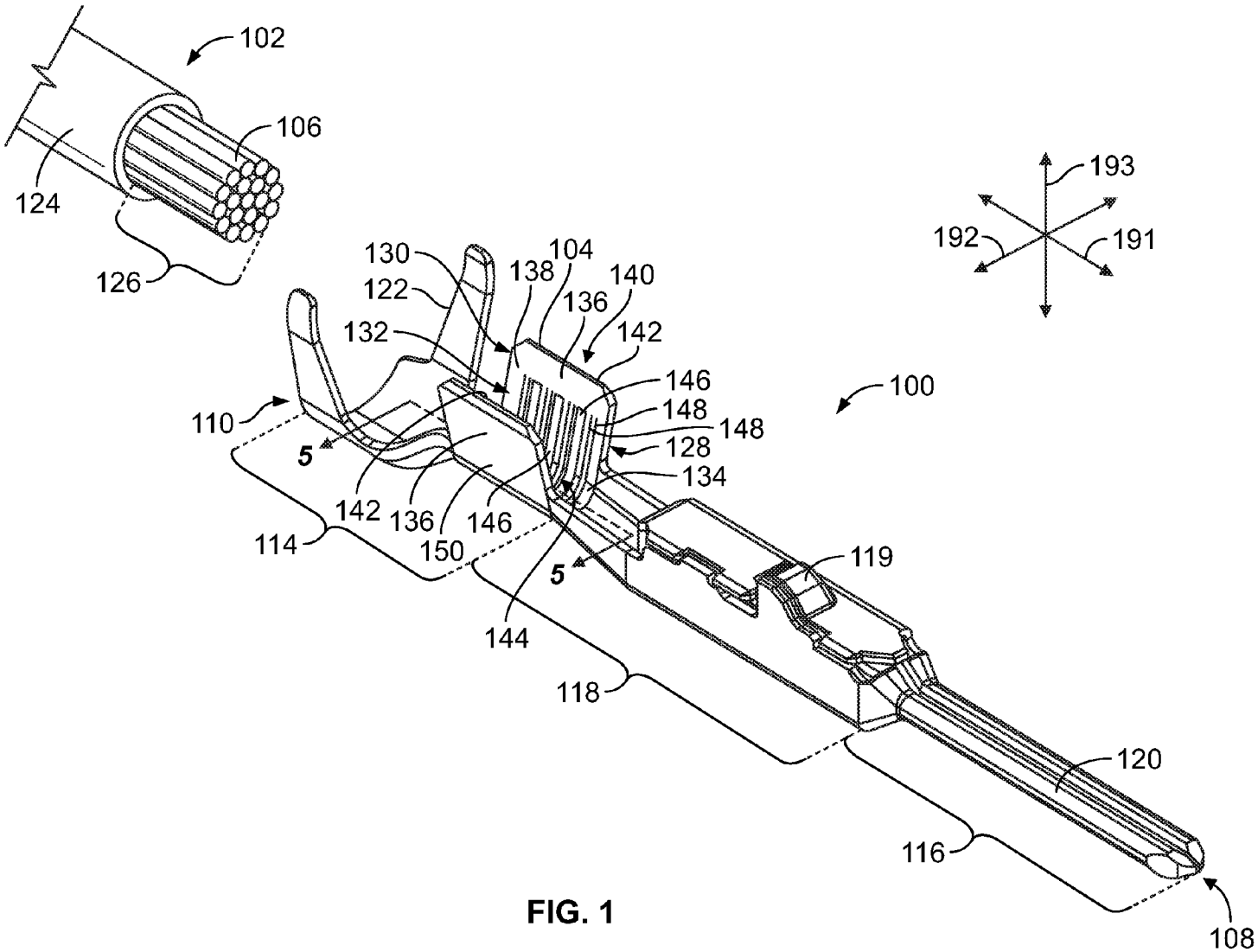
FIG. 1 is a perspective view of an electrical crimp terminal and an electrical device according to an embodiment.

FIG. 1 is a perspective view of an electrical crimp terminal 100 and an electrical device 102 according to an embodiment. The electrical device 102 may be a wire, a cable, or another structure with current-carrying conductors 106. The electrical device 102 is configured to be crimped to the terminal 100. The terminal 100 includes a crimp barrel 104 that receives a portion of the electrical device 102 therein. In FIG. 1, the electrical device 102 is poised for loading into the crimp barrel 104 prior to a crimping operation. During the crimping operation, the crimp barrel 104 is pressed into engagement with one or more electrical conductors 106 of the electrical device 102 to electrically connect the terminal 100 to the electrical device 102. The one or more electrical conductors 106 may be one or more metal wires, strands, or the like. The crimping operation also mechanically secures the terminal 100 to the electrical device 102, forming a terminal assembly (or electrical lead).

The terminal 100 is oriented with respect to a longitudinal axis 191, a lateral axis 192, and a vertical or elevation axis 193. The axes 191-193 are mutually perpendicular. Although the elevation axis 193 appears to extend generally parallel to gravity, it is understood that the axes 191-193 are not required to have any particular orientation with respect to gravity. The terminal 100 extends a length along the longitudinal axis 191 between a front end 108 and a rear end 110. The terminal 100 has a crimp segment 114, a contact segment 116, and a transition segment 118 that are spaced apart along the longitudinal axis 191. The crimp segment 114 defines the rear end 110, the contact segment 116 defines the front end 108, and the transition segment 118 is disposed between the crimp and contact segments 114, 116. As used herein, relative or spatial terms such as "front," "rear," "left," "right," "top," and "bottom" are only used to identify and distinguish the referenced elements and do not necessarily require particular positions or orientations relative to the surrounding environment of the terminal 100.

The contact segment 116 includes an electrical contact 120. In the illustrated embodiment, the electrical contact 120 is a pin or beam that is configured to be received in a socket or receptacle of a mating contact (not shown). But, the electrical contact 120 may have other shapes in other embodiments, such as, but not limited to a cage-shaped receptacle, a spring contact, a tab, a pole shoe, or the like. The transition segment 118 may provide structural support for the terminal 100 and/or a means for retaining the terminal 100 in a housing (not shown). For example, the transition segment 118 may include a protrusion 119 that is configured to engage a latch or shoulder of the housing. The crimp segment 114 includes the crimp barrel 104. In the illustrated embodiment, the crimp segment 114 also includes an insulation crimp barrel 122 that is disposed rearward of the crimp barrel 104 (which is a conductor crimp barrel). The insulation crimp barrel 122 is configured to be crimped into engagement with an insulation layer 124 of the electrical device 102. The insulation layer 124 surrounds the one or more electrical conductors 106. An exposed portion 126 of the one or more electrical conductors 106 protrudes from the insulation layer 124. The exposed portion 126 is received in the crimp barrel 104, unlike the insulation layer 124. In an alternative embodiment, the terminal 100 does not include the contact 120 and/or the transition segment 118. For example, the terminal 100 may only include the crimp barrel 104 and may be configured to join two electrical devices 102 end-to-end.

The crimp barrel 104 extends along the longitudinal axis 191 between a contact end 128 and a device end 130. The device end 130 is rearward of the contact end 128. The crimp barrel 104 defines a channel 132 that receives the exposed portion 126 of the one or more conductors 106 therein in preparation for a crimping operation. In the pre-crimped state of the terminal 100 shown in FIG. 1, the crimp barrel 104 has a U- or V-shaped cross-section taken along the lateral axis 192. The crimp barrel 104 includes a base 134 and two wings or tabs 136 that extend from laterally opposite lateral sides of the base 134. The channel 132 is defined by an interior side 138 of the barrel 104. The channel 132 is open along a top 140 of the terminal 100 between distal ends 142 of the wings 136. During the crimping operation, the wings 136 are bent towards one another into the channel 132 to engage the one or more conductors 106 of the electrical device 102. The terminal 100 is an "F" type terminal in an embodiment, but in other embodiments the terminal 100 may be an "0" type terminal that has a closed cylindrical barrel instead of an open, U-shaped barrel.

The crimp barrel 104 includes a serration array 144 along the interior side 138. The serration array 144, as shown and described in more detail herein, includes at least one primary serration 146 and at least one micro-serration 148 spaced apart along the longitudinal axis 191. Multiple primary serrations 146 and multiple micro-serrations 148 are shown in FIG. 1. The primary serrations 146 and micro-serrations 148 are recesses along the interior side 138 in the shape of grooves. The micro-serrations 148 have a smaller size than the primary serrations 146. As used herein, the term "micro-serrations" merely identifies a type of serration that is smaller in at least one size dimension than the primary serrations 146, and is not used to signify a specific size range or scale.

In the illustrated embodiment, the primary serrations 146 and the micro-serrations 148 are elongated laterally along the interior side 138 of the crimp barrel 104. For example, the serrations 146, 148 extend along the base 134 and along the wings 136 towards the distal ends 142 of the wings 136. Each serration 146, 148 may extend continuously from one wing 136 to the other wing 136, or may be divided into multiple segments along the lateral length of the respective serration 146, 148. In an embodiment, the primary serrations 146 extend parallel to one another. The micro-serrations 148 extend parallel to one another and parallel to the primary serrations 146. The primary serrations 146 and the micro-serrations 148 extend transverse to the longitudinal axis 191, such as perpendicular to the longitudinal axis 191.

During a crimping operation, the exposed portion 126 of the one or more conductors 106 is received in the channel 132 of the crimp barrel 104, and the electrical device 102 extends from the device end 130 of the crimp barrel 104. The one or more conductors 106 are held generally coaxial with the longitudinal axis 191. The serrations 146, 148 of the serration array 144 extend around a perimeter of the one or more conductors 106. The terminal 100 is located on an anvil (not shown) of a crimping apparatus. A crimp tooling member (not shown) of the crimping apparatus descends from above the terminal 100. The crimp tooling member engages an exterior side 150 of the crimp barrel 104 and bends the wings 136 to engage and surround the one or more conductors 106 in the channel 132. The serration array 144, as described herein, is configured to wipe and/or scrape an exterior surface of the one or more conductors 106 as the crimp barrel 104 is compressed around the conductors 106 to remove and/or displace an oxide layer on the conductors 106, creating metal-to-metal bonds via cold welding.

Figure 2:
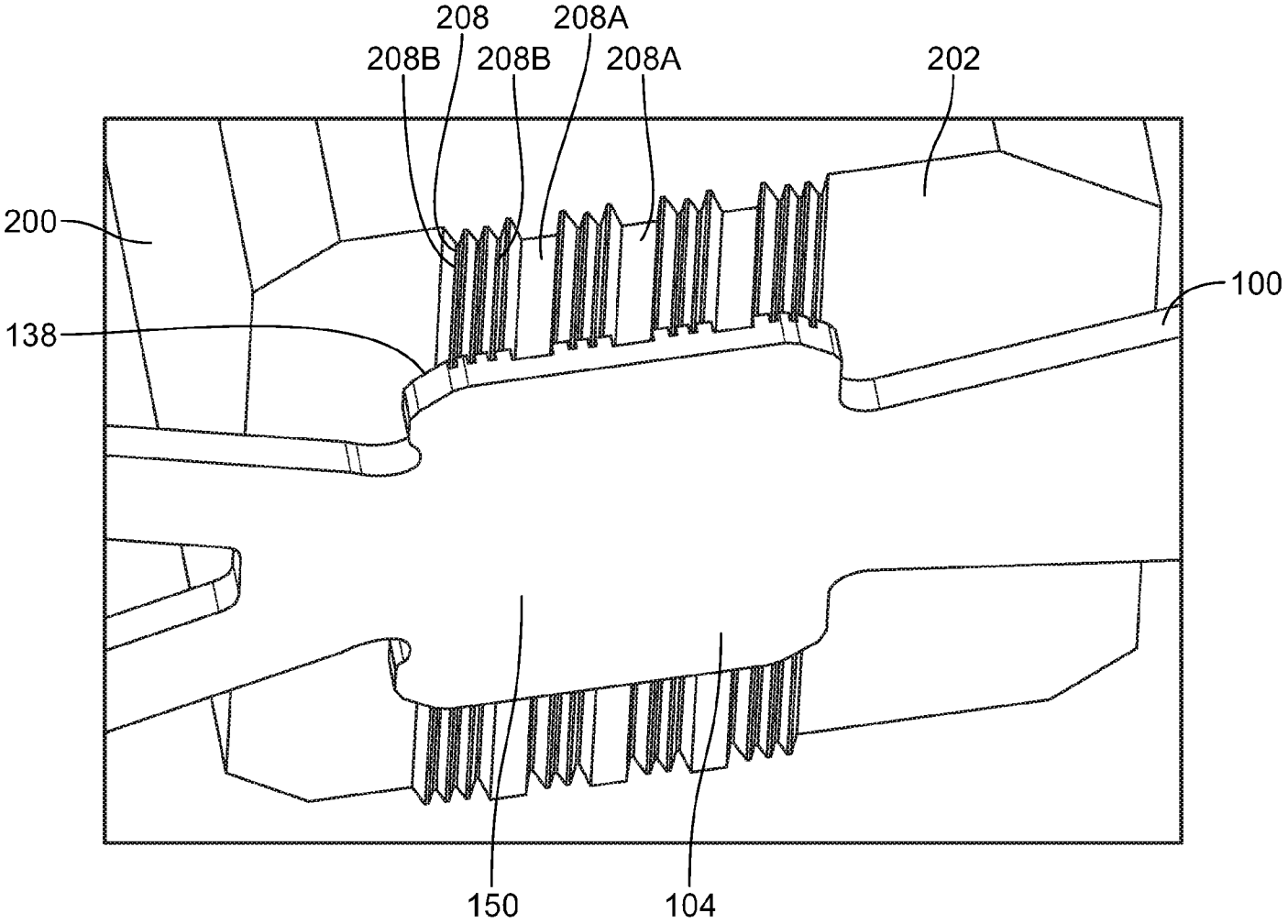
FIG. 2 is a bottom perspective view of a punching die and a portion of the electrical crimp terminal according to an embodiment.
Figure 3:
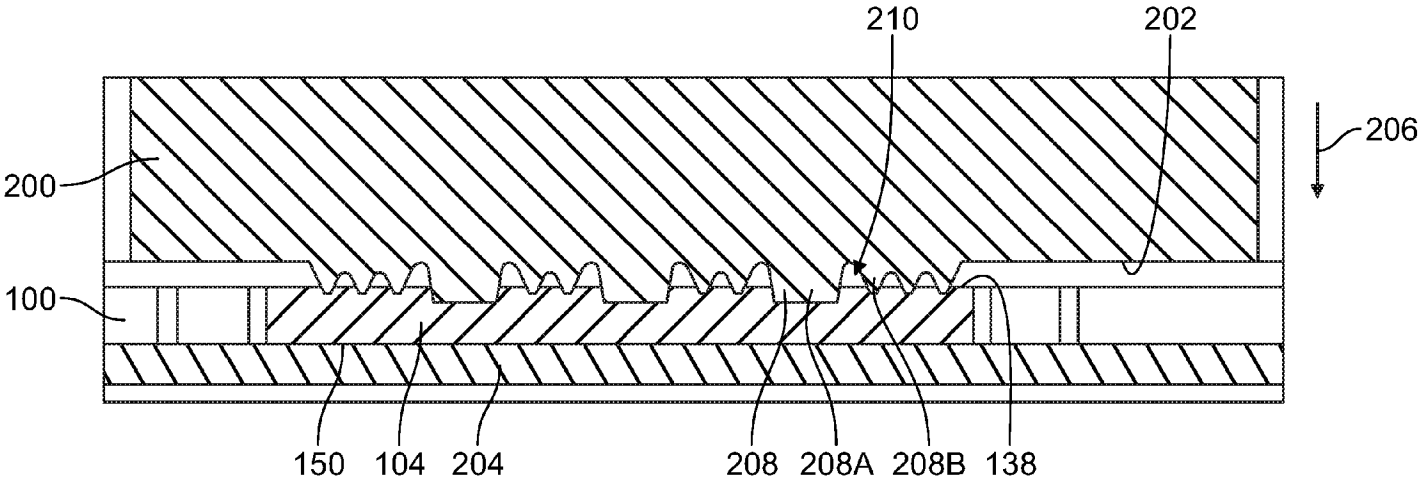
FIG. 3 is a cross-sectional view showing the punching die in contact with a crimp barrel of the electrical crimp terminal.
Figure 4:
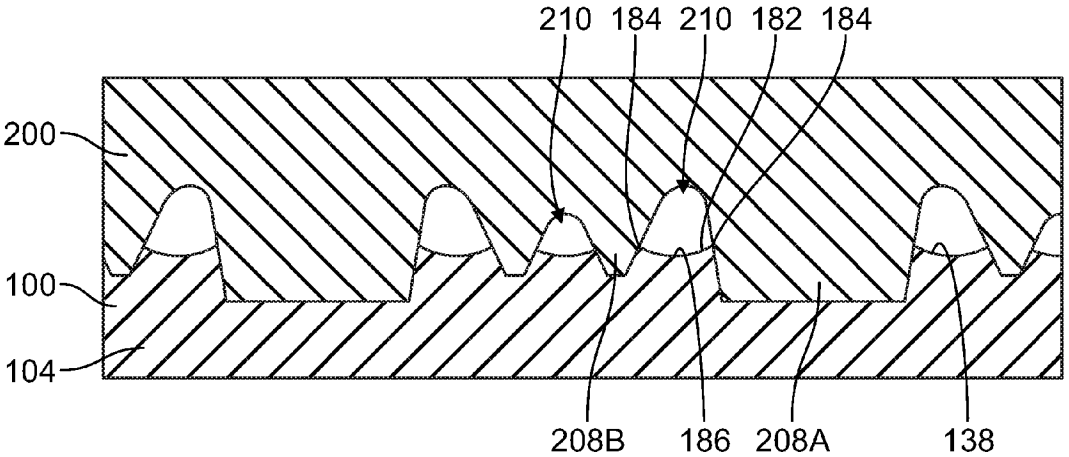
FIG. 4 is a close-up portion of the punching die and the crimp barrel shown in FIG. 3.

FIG. 2 is a bottom perspective view of a punching die 200 and a portion of the terminal 100 according to an embodiment. In FIG. 2, a bottom side 202 of the punching die 200 engages the interior side 138 of the crimp barrel 104 to form the serration array 144 (shown in FIG. 1). FIG. 3 is a cross-sectional view showing the punching die 200 in contact with the crimp barrel 104. FIG. 4 is a close-up portion of the punching die 200 and the crimp barrel 104 shown in FIG. 3.

The terminal 100 is shown in FIGS. 2-4 having a flat, planar shape. For example, the terminal 100 may be produced by stamping and forming a metal panel or sheet. As shown in FIG. 2, the terminal 100 has already been stamped prior to contacting the punching die 200, but the terminal 100 has not yet been formed. The crimp barrel 104 is formed into the U-shape shown in FIG. 1 subsequent to forming the serration array 144. Although not shown in FIG. 2, the terminal 100 may be placed on a die plate 204 for the punching operation shown in FIGS. 2-4. As show in FIG. 3, the exterior side 150 of the crimp barrel 104 engages the die plate 204, and the punching die 200 is moved in a punching direction 206 vertically towards the terminal 100 from above the terminal 100.

The punching die 200 includes multiple elongated ridges 208 that protrude from the bottom side 202 thereof. The ridges 208 engage the interior side 138 of the crimp barrel 104 to form the serration array 144 (shown in FIG. 1). In an embodiment, the ridges 208 include primary ridges 208A and micro-ridges 208B. The primary ridges 208A have a larger size than the micro-ridges 208B. The primary ridges 208A form the primary serrations 146 (shown in FIG. 1), and the micro-ridges 208B form the micro-serrations 148 (FIG. 1). As shown in FIG. 2, the primary ridges 208A extend parallel to the micro-ridges 208B. The ridges 208 may be formed by machining the bottom side 202 of the punching die 200 to define the protruding ridges 208. As shown in FIG. 2, the punching die 200 includes multiple micro-ridges 208B on either side of each primary ridge 208A such that multiple micro-ridges 208B are disposed between each pair of adjacent primary ridges 208A. The ridges 208A, 208B may be configured in other arrangements in other embodiments.

FIGS. 3 and 4 show the punching die 200 at a bottom dead position relative to the die plate 204 and the terminal 100 thereon. The bottom dead position represents the end of a punch stroke. Therefore, the punching die 200 does not move closer to the die plate 204 than the position shown in FIGS. 3 and 4. At the bottom dead position, the ridges 208 engage the terminal 100 and protrude into the interior side 138. The portions of the bottom side 202 of the punching die 200 surrounding the ridges 208 and between the ridges 208 are spaced apart from and do not engage the terminal 100. The terminal 100 is compressed between the ridges 208 of the punching die 200 and the die plate 204. As the ridges 208 compress the terminal 100 along the crimp barrel 104, the ridges 208 displace some of the metal material of the terminal 100. For example, the ridges 208 force the metal material to flow to areas of reduced pressure, such as into the cavities 210 between adjacent ridges 208. As shown in FIG. 4, the interior side 138 of the terminal 100 between adjacent ridges 208 defines concave surfaces 182. The concave surfaces 182 are bowed between outer edges 184 such that a middle portion 186 of each concave surface 182 is more proximate to the exterior side 150 (shown in FIG. 3) of the crimp barrel 104 than a proximity of the outer edges 184 to the exterior side 150. Thus, the outer edges 184 are raised relative to the middle portion 186. The concave surfaces 182 are formed from the displacement of metal material of the terminal 100 as the ridges 208 penetrate the crimp barrel 104.

Figure 5:
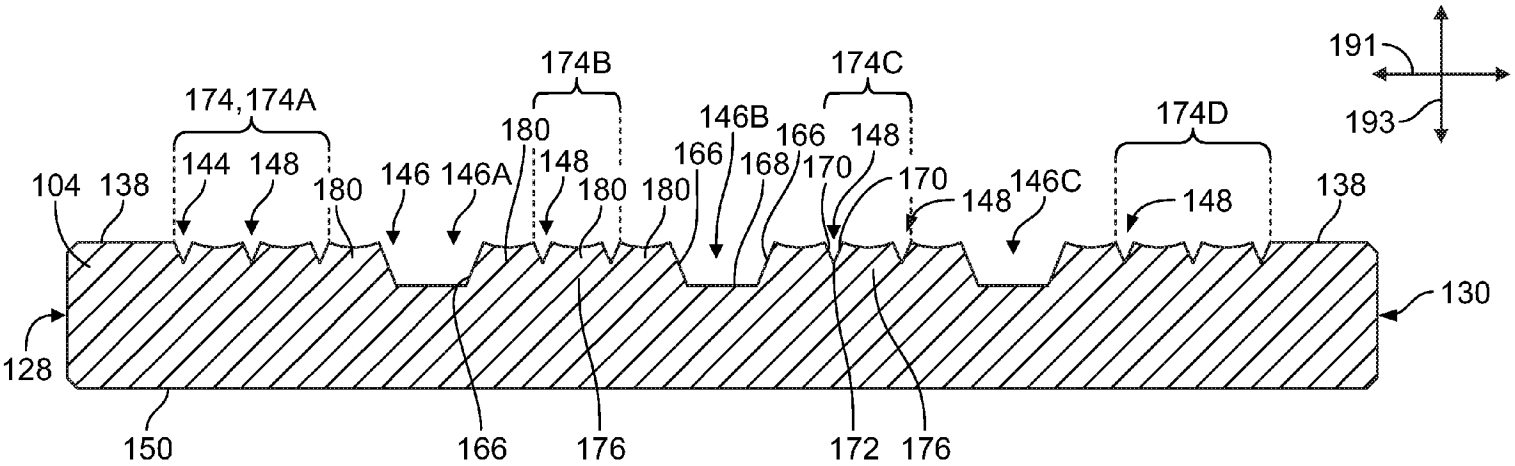
FIG. 5 is a cross-sectional view of a serration array on the crimp barrel of the electrical crimp terminal taken along line 5-5 shown in FIG. 1.
Figure 6:
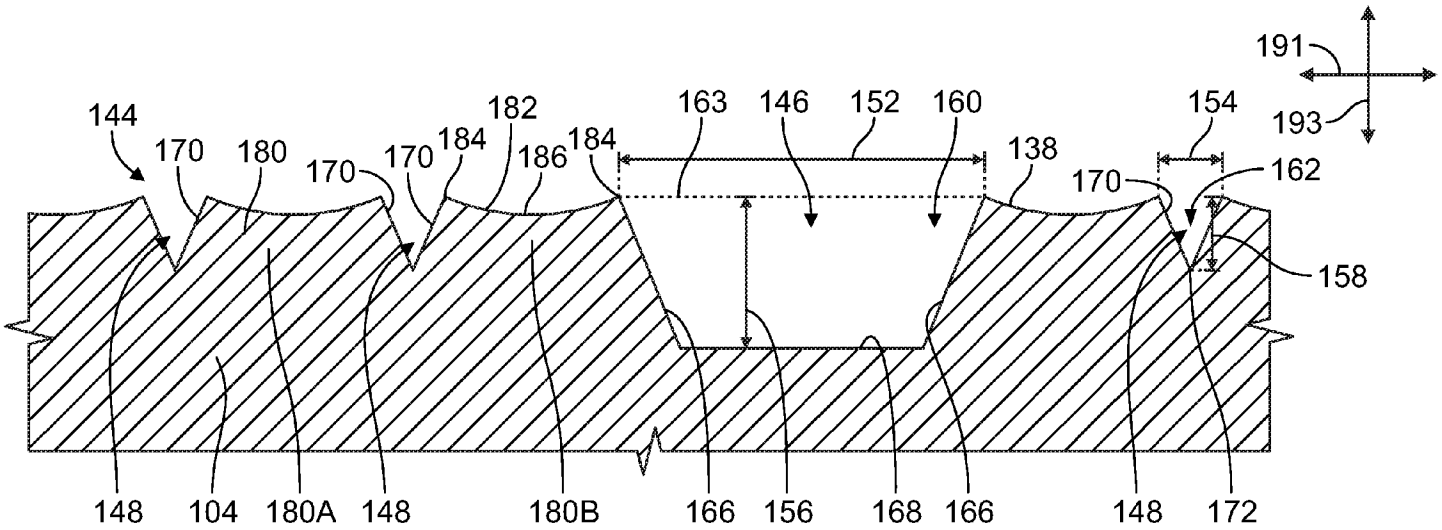
FIG. 6 is a close-up portion of the serration array on the crimp barrel shown in FIG. 5.

FIG. 5 is a cross-sectional view of the serration array 144 on the crimp barrel 104 of the terminal 100 (shown in FIG. 1) taken along line 5-5 shown in FIG. 1. FIG. 6 is a close-up portion of the serration array 144 on the crimp barrel 104 shown in FIG. 5. The serration array 144 in the illustrated embodiment extends a majority of the length of the crimp barrel 104 along the longitudinal axis 191 between the contact end 128 and the device end 130. In an alternative embodiment, the serration array 144 may extend less than half of the length of the crimp barrel 104, and the crimp barrel 104 optionally may include multiple serration arrays 144. The serration array 144 includes multiple primary serrations 146 and multiple micro-serrations 148. The primary serrations 146 and the micro-serrations 148 are both recesses defined along the interior side 138 of the crimp barrel 104. The primary serrations 146 are formed by the primary ridges 208A (shown in FIG. 3), and the micro-serrations 148 are formed by the micro-ridges 208B (FIG. 3). Thus, the primary serrations 146 and the micro-serrations 148 are recesses that have generally the same shapes as the primary ridges 208A and micro-ridges 208B, respectively. The primary serrations 146 have larger sizes than the micro-serrations 148, such that the primary serrations 146 are larger cavities than the micro-serrations 148.

The primary serrations 146 have two side walls 166 and a bottom wall 168 between the side walls 166. The side walls 166 may be tapered towards each other from the interior side 138 to the bottom wall 168 such that a width 152 of the primary serration 146 along the longitudinal axis 191 at the interior side 138 is greater than the width of the bottom wall 168. In the illustrated embodiment, the primary serrations 146 have a trapezoidal cross-sectional shape, but the primary serrations 146 may have other shapes in other embodiments, such as rectangular, triangular, pentagonal, or the like. The micro-serrations 148 have two side walls 170 that taper towards each other with depth from the interior side 138 toward the exterior side 150. In the illustrated embodiment, the micro-serrations 148 have a generally triangular shape such that the two side walls 170 meet at a point 172 of the micro-serration 148. Alternatively, the side walls 170 may connect to a narrow bottom wall similar to the bottom wall 168 of the primary serrations 146 instead of meeting at the point 172.

The width 152 of the primary serrations 146 along the longitudinal axis 191 at the interior side 138 is greater than a width 154 of the micro-serrations 148. For example, the width 152 of the primary serrations 146 may be between two and ten times as wide as the width 154 of the micro-serrations 148. The primary serrations 146 and the micro-serrations 148 have respective depths 156, 158 that extend from the interior side 138 towards the exterior side 150 of the crimp barrel 104. The depth 156 of the primary serrations 146 is greater than the depth of the micro-serrations 148. For example, the depth 156 of the primary serrations 146 may be two times as deep as the depth 158 of the micro-serrations 148. The primary serrations 146 have a cross-sectional area 160 along the longitudinal axis 191 that is greater than a cross-sectional area 162 of the micro-serrations 148. The cross-sectional areas 160, 162 are defined between the walls of the respective serrations 146, 148 and a plane 163 of the interior side 138. For example, in an embodiment, the cross-sectional area 162 of a micro-serration 148 may be less than half, less than one-third, less than one-fourth, and/or less than one-fifth of the cross-sectional area 160 of a primary serration 146. In an alternative embodiment, the depth 156 of the primary serrations 146 may be equal to or less than the depth 158 of the micro-serrations 148, although the width 152 of the primary serrations 146 is greater than the width 154 of the micro-serrations 148 such that the cross-sectional area 160 of the primary serrations 146 is greater than the cross-sectional area 162 of the micro-serrations 148.

In an embodiment, the primary serrations 146 and micro-serrations 148 in the serration array 144 are arranged with at least one micro-serration 148 between two adjacent primary serrations 146. As used herein, adjacent primary serrations 146 refers to two primary serrations 146 that do not have any intervening primary serrations 146 therebetween, although there are intervening micro-serrations 148 between the adjacent primary serrations 146. The serration array 144 may have an alternating sequence of primary serrations 146 and groups 174 of micro-serrations 148. Each group 174 of micro-serrations 148 includes at least one micro-serration 148. In the illustrated embodiment, each group 174 has at least two micro-serrations 148, and some groups 174 have three micro-serrations 148. The groups 174 and the primary serrations 146 alternate along the length of the array 144 between the contact end 128 and the device end 130 of the crimp barrel 104. The array 144 in the illustrated embodiment includes three primary serrations 146 and four groups 174 of micro-serrations 148. Each primary serration 146 is surrounded on each side (for example, on both a contact end-side and a device end-side) by a corresponding group 174 of micro-serrations 148. In the illustrated embodiment, the serration array 144 includes a first primary serration 146A, a second primary serration 146B, and a third primary serration 146C. The serration array 144 further includes a first group 174A of multiple micro-serrations 148 that is disposed between the contact end 128 and the first primary serration 146A, a second group 174B of micro-serrations 148 that is disposed between the first and second primary serrations 146A, 146B, a third group 174C of micro-serrations 148 that is disposed between the second and third primary serrations 146B, 146C, and a fourth group 174D of micro-serrations 148 that is disposed between the third primary serration 146C and the device end 130. The array 144 may include different numbers and/or arrangements of the primary serrations 146 and the micro-serrations 148 in other embodiments. For example, in one alternative embodiment, one or both axial ends of the array 144 (most proximate to the contact end 128 and the device end 130) may be defined by a primary serration 146 instead of by a micro-serration 148.

Since the primary serrations 146 are larger recesses than the micro-serrations 148, two adjacent primary serrations 146 define a band 176 therebetween. Each band 176 is a portion of the crimp barrel 104 with sides defined by respective side walls 166 of the adjacent primary serrations 146. The band 176 has a height along the vertical axis 193 that is generally equal to the height of the side walls 166 along the vertical axis 193. At least some of the bands 176 include a group 174 of at least one micro-serration 148 thereon. For example, in an embodiment, each band 176 includes multiple micro-serrations 148 that are spaced apart from one another along the longitudinal axis 191. Since there are three primary serrations 146A-C shown in FIG. 5, the primary serrations 146A-C define two bands 176, with one band 176 on each side of the second, or inner, serration 146B. The first and third primary serrations 146A, 146C are outer primary serrations along the length of the array 144. Each of the outer serrations 146A, 146C defines a side of a corresponding band 176 on only an inner side of the respective outer serration 146A, 146C which faces towards the inner serration 146B. The portions of the interior side 138 of the crimp barrel 104 along the respective outer sides of the outer serrations 146A, 146C, which face away from the inner serration 146B, include at least one micro-serration 148 in the illustrated embodiment. Thus, micro-serrations 148 may be disposed on both sides of each of the primary serrations 146.

The primary serrations 146 and the micro-serrations 148 define barrel teeth 180 between adjacent serrations 146, 148. Some barrel teeth 180 are defined between two micro-serrations 148, and other barrel teeth 180 are defined between one micro-serration 148 and one primary serration 146. Each barrel tooth 180 has a top surface 182 and two sides extending from corresponding edges 184 of the top surface 182. The sides of each tooth 180 are defined by the side walls 166, 170 of the respective serrations 146, 148 that define the corresponding tooth 180. For example, the sides of a barrel tooth 180A defined between two adjacent micro-serrations 148 are defined by two side walls 170 and may have equal heights along the vertical axis 193. The sides of a barrel tooth 180B defined between one primary serration 146 and one micro-serration 148, on the other hand, may have different heights because one side is defined by a side wall 166 of the primary serration 146 and the other side is defined by a side wall 170 of the micro-serration 148. The sides of the teeth 180 in the illustrated embodiment are tapered or sloped such that the teeth 180 have generally trapezoidal shapes, but the teeth 180 may have other shapes in other embodiments, such as rectangular shapes. The edges 184 of the barrel teeth 180 are configured to engage and scrape against the one or more electrical conductors 106 (shown in FIG. 1) of the electrical device 102 (FIG. 1) during a crimping operation to remove and/or displace an oxide layer to form metal-to-metal contacts. The serration array 144 in the illustrated embodiment includes 26 discrete edges 184, but other amounts of teeth 180 and edges 184 may be formed in other embodiments.

In the illustrated embodiment, the top surfaces 182 of at least some of the barrel teeth 180 are concave. For example, the top surface 182 of a respective tooth 180 bows or curves towards the exterior side 150 of the crimp barrel 104 with distance along the width of the tooth 180 between the edges 184. A middle portion 186 of the top surface 182 of a respective tooth 180 is located more proximate to the exterior side 150 than a proximity of each of the edges 184 of the tooth 180 to the exterior side 150. The top surfaces 182 may be concave due to the pressing operation that forms the serrations 146, 148 in the interior side 138 of the crimp barrel 104, as described above with reference to FIG. 4. The concave top surfaces 182 of the barrel teeth 180 allow the edges 184 to have relatively sharp angles, which may enhance the scraping of the edges 184 against the one or more electrical conductors 106. The top surfaces 182 of the barrel teeth 180 may be relatively linear in an alternative embodiment.

Figure 7:
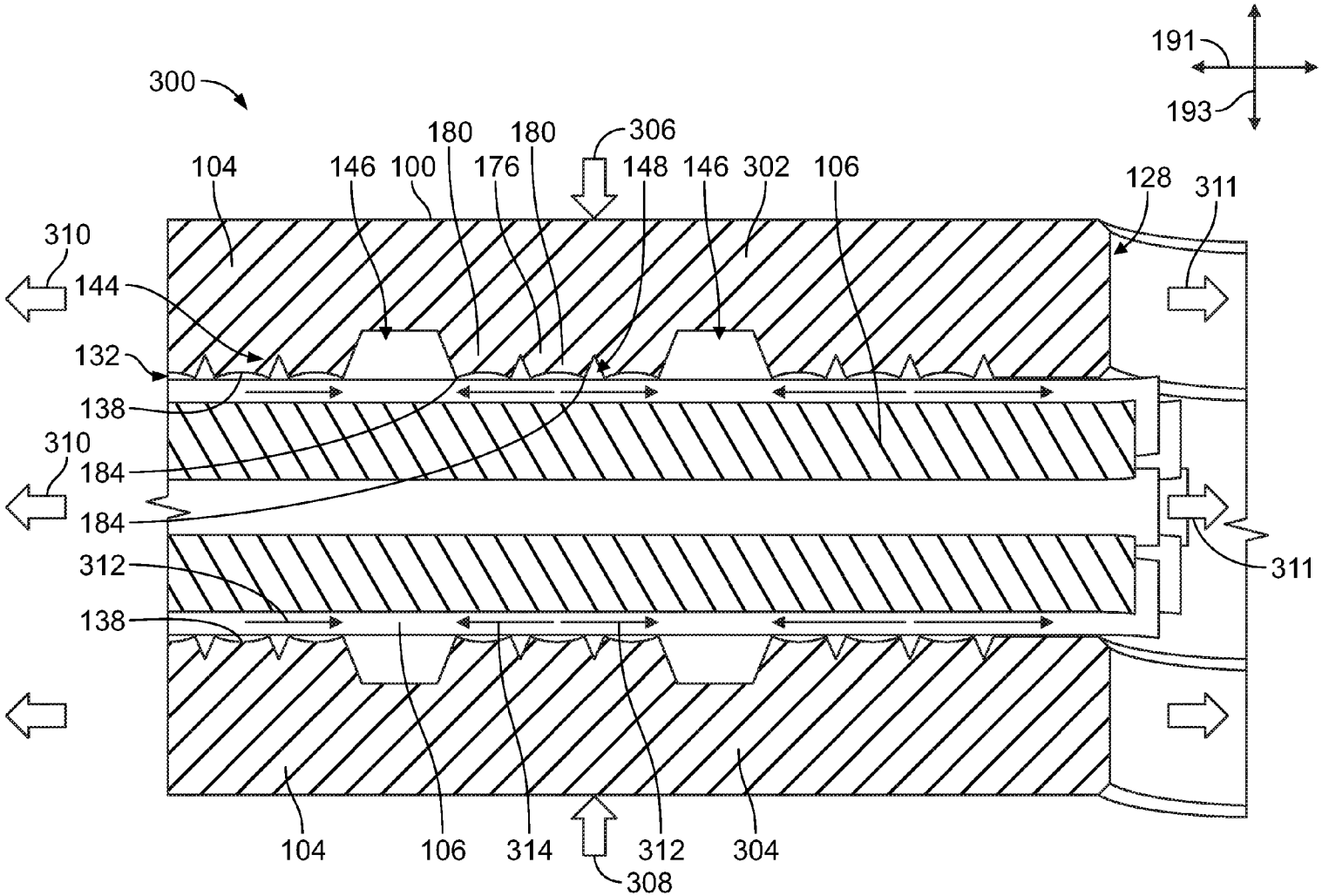
FIG. 7 is a cross-sectional view of a portion of a terminal assembly including one or more conductors of the electrical device in the crimp barrel of the electrical crimp terminal.
Figure 8:
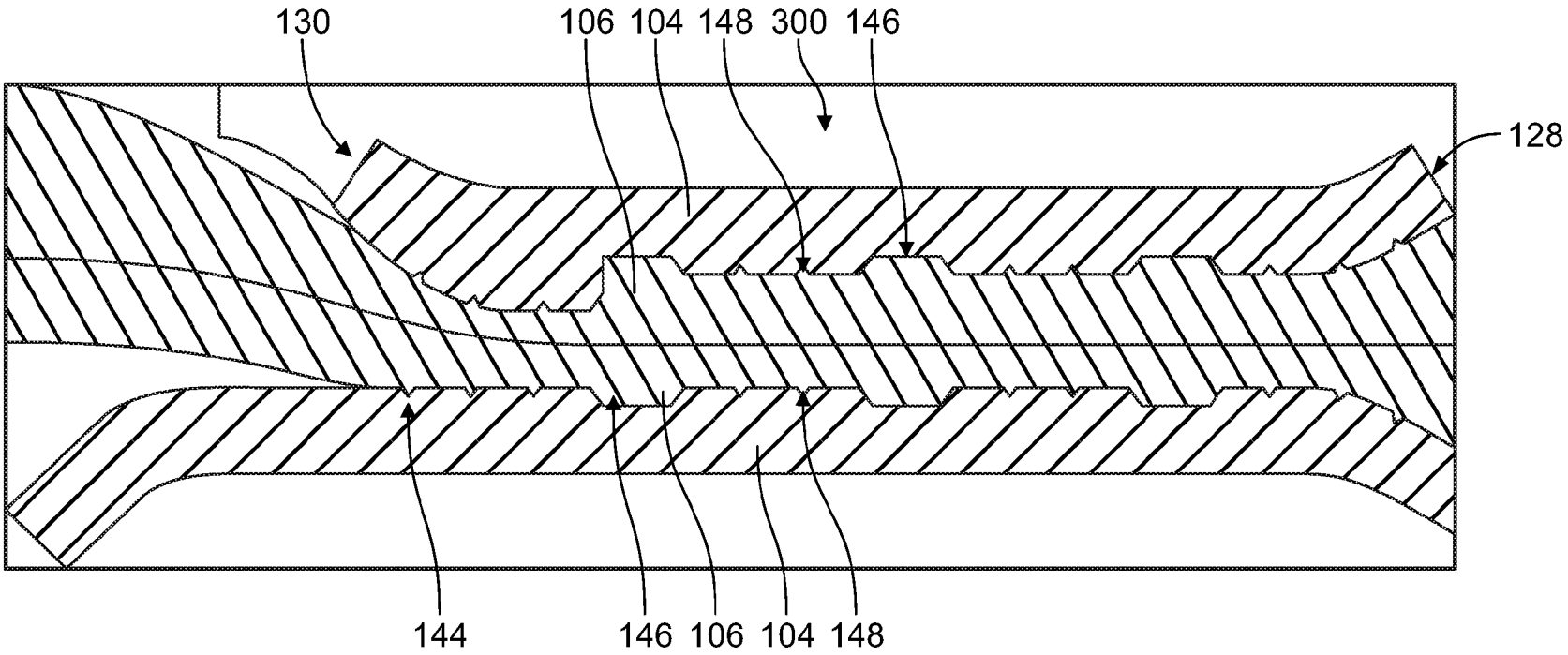
FIG. 8 shows the terminal assembly in a post-crimped state according to an embodiment, such that the crimp barrel is compressed into mechanical engagement and electrical contact with the one or more conductors of the electrical device.

FIG. 7 is a cross-sectional view of a portion of a terminal assembly 300 including the one or more conductors 106 of the electrical device 102 (shown in FIG. 1) in the channel 132 of the crimp barrel 104 of the terminal 100. In FIG. 7, the terminal assembly 300 is in a pre-crimped state. FIG. 8 shows the terminal assembly 300 in a post-crimped state according to an embodiment, such that the crimp barrel 104 is compressed into mechanical engagement and electrical contact with the conductors 106. Referring to FIG. 7, during a crimping operation a crimping apparatus compresses the crimp barrel 104 along the vertical axis 193 such that opposing portions 302, 304 of the crimp barrel 104 are forced inwardly into the channel 132 towards one another along respective crimping directions 306, 308. The interior side 138 of the crimp barrel 104 engages and compresses the one or more conductors 106, causing the metal of the conductors 106 to extrude (for example, flow, slide, or otherwise move) to regions of reduced pressure. Typically, the primary regions of reduced pressure are at the contact end 128 and the device end 130 (shown in FIG. 8) of the crimp barrel 104. Thus, during the crimping operation, the metal of the conductors 106 may flow in expanding directions 310, 311 towards the ends 128, 130.

In an embodiment, the metal of the crimp barrel 104 may also flow in the expanding directions 310, 311 due to the compressive forces. For example, the crimp barrel 104 may be composed of one or more metals that have a relatively similar strength (or modulus of elasticity) as the one or more metals of the conductors 106. The conductors 106 may be composed of a first metal material including at least one of copper or aluminum, and the terminal 100 may be composed of a second metal material that also include at least one of copper or aluminum. Optionally, the metal materials of the conductors 106 may be the same as the metal materials of the terminal 100. Since the strength of the conductors 106 may be at least similar to the strength of the terminal 100, there may be little differential metal flow between the crimp barrel 104 and the conductors 106 proximate to the interior side 138 of the crimp barrel 104 during the crimping operation, which limits the ability of the crimp barrel 104 to scrape against the conductors 106 to displace oxide layers and establish reliable metal-to-metal contacts. However, the serration array 144 is configured to utilize local areas of differential flow to enhance the scraping, even when the metal material of the terminal 100 is similar in strength to the metal materials of the conductors 106.

As shown in FIG. 7, the primary serrations 146 define areas or pockets of reduced pressure. During the crimping operation, some metal of the conductors 106 proximate to the primary serrations 146 flows axially along opposite first and second directions 312, 314 towards the corresponding primary serrations 146 and at least partially fills the primary serrations 146. As shown in FIG. 8, the metal of the conductors 106 fills each of the primary serrations 146 due to the compressive forces during the crimping operation. In an embodiment, as the metal of the conductors 106 proximate to the crimp barrel 104 flows in the first and second directions 312, 314 relative to the crimp barrel 104, the edges 184 of the barrel teeth 180 along the interior side 138 of the crimp barrel 104 engage and scrape against the conductors 106. For example, a segment of one conductor 106 disposed in engagement with the interior side 138 of the crimp barrel 104 along one of the bands 176 may be stretched in both directions 312, 314 towards the primary serrations 146 located on both sides of the band 176. As the metal material of the conductor 106 is stretched, the edges 184 of the barrel teeth 180 along the band 176 (defined by the primary serrations 146 and the micro-serrations 148) scrape and wipe against the flowing metal material to remove and/or displace an oxide layer or other surface contaminants on the conductor 106. The scraping provides a reliable metal-to-metal contact between the crimp barrel 104 and the conductor 106, which supports the electrical conductivity of the resulting terminal assembly 300.

Thus, the serration array 144 is configured to provide reliable metal-to-metal electrical contacts between the crimp barrel 104 and the one or more conductors 106, even when there is little relative extrusion flow between the crimp barrel 104 and the conductors 106 due to a similarity in metal strength characteristics. Experimental testing has demonstrated that terminals 100 having the serration array 144 form terminal assemblies having more desirable electrical conductivity characteristics than some known terminals that do not include the serration array 144 described herein, such as lower initial resistance measurements, lower final resistance measurements after testing, and/or lower delta resistance measurements after testing at various terminal sizes.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical terminal comprising:

a crimp barrel having an interior side and an exterior side, the interior side of the crimp barrel defining a channel that extends along a longitudinal axis, the crimp barrel configured to mechanically hold and electrically connect to one or more electrical conductors of an electrical device received in the channel, the crimp barrel including multiple primary serrations spaced apart along the longitudinal axis, the primary serrations being groove-shaped recesses formed along the interior side, adjacent primary serrations being separated from one another by a band, the crimp barrel further including at least one micro-serration on the band such that the at least one micro-serration on the band is disposed between the adjacent primary serrations, each micro-serration being a groove-shaped recess formed along the interior side that has a smaller size relative to the primary serrations.

2. The electrical terminal of claim 1, wherein each primary serration has a width along the longitudinal axis that is greater than a width of each micro-serration along the longitudinal axis.

3. The electrical terminal of claim 1, wherein the primary serrations and the at least one micro-serration have respective depths that extend from the interior side of the crimp barrel towards the exterior side, the depths of the primary serrations being greater than the depth of each micro-serration.

4. The electrical terminal of claim 1, wherein a cross-sectional area of the recess of each micro-serration along the longitudinal axis is less than a cross-sectional area of the recess of each primary serration along the longitudinal axis.

5. The electrical terminal of claim 4, wherein the cross-sectional area of the recess of each micro-serration is less than one-fifth of the cross-sectional area of the recess of each primary serration.

6. The electrical terminal of claim 1, wherein the band between adjacent primary serrations includes multiple micro-serrations spaced apart along the longitudinal axis.

7. The electrical terminal of claim 1, wherein the primary serrations and the at least one micro-serration are elongated laterally along the interior side of the crimp barrel to at least partially surround the one or more electrical conductors in the crimp barrel, the primary serrations extending parallel to one another and to the at least one micro-serration.

8. The electrical terminal of claim 1, wherein each micro-serration on the band extends between and partially defines two adjacent barrel teeth, each barrel tooth having a top surface that faces the channel and two tapered sides extending from corresponding edges of the top surface, the edges of the barrel teeth configured to engage and scrape against the one or more electrical conductors during a crimping operation to form metal-to-metal contacts.

9. The electrical terminal of claim 8, wherein the top surfaces of the barrel teeth are concave such that the top surface of a respective barrel tooth bows between the edges towards the exterior side.

10. The electrical terminal of claim 1, wherein the primary serrations include two outer primary serrations, each outer primary serration defining a side of a corresponding band on only an inner side of the outer primary serration, the crimp barrel further including at least one micro-serration along the interior side of the crimp barrel on an opposite outer side of each outer primary serration such that micro-serrations are located on both sides of each primary serration.

11. The electrical terminal of claim 1, wherein the crimp barrel extends along the longitudinal axis between a contact end and a device end, the primary serrations and at least one micro-serration are arranged in a serration array that includes first, second, and third primary serrations such that the second primary serration is disposed between the first and third primary serrations, the serration array further including a first group of multiple micro-serrations disposed between the contact end and the first primary serration, a second group of multiple micro-serrations disposed between the first and second primary serrations, a third group of multiple micro-serrations disposed between the second and third primary serrations, and a fourth group of multiple micro-serrations disposed between the third primary serration and the device end.

12. The electrical terminal of claim 1, wherein the crimp barrel extends along the longitudinal axis between a contact end and a device end, the electrical device received in the channel extending from the device end of the crimp barrel, the electrical terminal further comprising an electrical contact connected to the contact end of the crimp barrel via a transition segment of the electrical terminal.

13. An electrical terminal comprising:

a crimp barrel extending along a longitudinal axis between a contact end and a device end, the crimp barrel having an interior side that defines a channel extending along the longitudinal axis, the crimp barrel configured to mechanically hold and electrically connect to one or more electrical conductors of an electrical device received in the channel, the crimp barrel including multiple primary serrations and multiple micro-serrations in a serration array, the primary serrations and the micro-serrations being groove-shaped recesses formed along the interior side, the micro-serrations having a smaller size relative to the primary serrations, the micro-serrations arranged in groups of at least one micro-serration, the groups of the micro-serrations and the primary serrations arranged in an alternating sequence along the longitudinal axis such that one of the primary serrations is disposed between adjacent groups of micro-serrations and one of the groups of micro-serrations is disposed between adjacent primary serrations.

14. The electrical terminal of claim 13, wherein each primary serration is bordered on a contact end-side of the primary serration by one group of micro-serrations and on an opposite device end-side by another group of micro-serrations.

15. The electrical terminal of claim 13, wherein the primary serrations and the groups of micro-serrations are elongated laterally along the interior side of the crimp barrel to at least partially surround the one or more electrical conductors in the crimp barrel, the primary serrations extending parallel to one another and to the micro-serrations.

16. The electrical terminal of claim 13, wherein each primary serration has a width along the longitudinal axis that is greater than a width of each micro-serration along the longitudinal axis.

17. The electrical terminal of claim 13, wherein the primary serrations and the micro-serrations have respective depths that extend from the interior side of the crimp barrel towards an exterior side of the crimp barrel opposite the interior side, the depths of the primary serrations being greater than the depths of the micro-serrations.

18. An electrical terminal comprising:

a crimp barrel having an interior side and an exterior side, the interior side of the crimp barrel defining a channel that extends along a longitudinal axis, the crimp barrel configured to mechanically hold and electrically connect to one or more electrical conductors of an electrical device received in the channel, the crimp barrel including multiple primary serrations spaced apart along the longitudinal axis, adjacent primary serrations being separated from one another by a band, the crimp barrel further including at least one micro-serration on the band such that the at least one micro-serration on the band is disposed between the adjacent primary serrations, the primary serrations and the at least one micro-serration being groove-shaped recesses formed along the interior side, the micro-serrations having a smaller size relative to the primary serrations, wherein the primary serrations and the at least one micro-serration define barrel teeth along the interior side of the crimp barrel, each barrel tooth having a top surface that faces the channel and two tapered sides extending from corresponding edges of the top surface, the edges of the barrel teeth configured to engage and scrape against the one or more electrical conductors during a crimping operation to form metal-to-metal contacts.

19. The electrical terminal of claim 18, wherein the top surfaces of the barrel teeth are concave such that the top surface of a respective barrel tooth bows between the edges towards the exterior side of the crimp barrel.

20. The electrical terminal of claim 18, wherein the primary serrations have respective depths extending from the interior side of the crimp barrel towards the exterior side that are greater than a respective depth of the at least one micro-serration, a corresponding barrel tooth disposed between one primary serration and one micro-serration has a first tapered side defined by the primary serration and a second tapered side defined by the micro-serration, the first tapered side having a greater height than the second tapered side.

* * * * *